US008430802B2

(12) United States Patent
Treccani et al.

(10) Patent No.: US 8,430,802 B2
(45) Date of Patent: Apr. 30, 2013

(54) PRESS AND METHOD IN PARTICULAR FOR THE PRESSURE FORMING OF PAPER CONTAINERS

(75) Inventors: Giuseppe Treccani, Capriano Del Colle (IT); Mauro Leali, Capriano Del Colle (IT)

(73) Assignee: Quality Tools S.r.l., Brescia (IT)

( * ) Notice: Subject to any disclaimer, the term of this patent is extended or adjusted under 35 U.S.C. 154(b) by 337 days.

(21) Appl. No.: 12/988,741

(22) PCT Filed: Apr. 16, 2009

(86) PCT No.: PCT/IT2009/000170

§ 371 (c)(1),
(2), (4) Date: Oct. 20, 2010

(87) PCT Pub. No.: WO2009/130731

PCT Pub. Date: Oct. 29, 2009

(65) Prior Publication Data

US 2011/0039673 A1 Feb. 17, 2011

(30) Foreign Application Priority Data

Apr. 21, 2008 (IT) ..... BS2008A0085

(51) Int. Cl.
*B31D 5/02* (2006.01)

(52) U.S. Cl.
USPC ..... 493/185; 493/73; 493/79; 493/464; 100/38; 100/92

(58) Field of Classification Search ..... 493/52, 493/56, 61, 73, 79, 160, 162, 167, 185, 464
See application file for complete search history.

(56) References Cited

U.S. PATENT DOCUMENTS

| | | | | |
|---|---|---|---|---|
| 3,584,487 | A * | 6/1971 | Carlson | 72/38 |
| 4,721,500 | A * | 1/1988 | Van Handel et al. | 493/152 |
| 4,832,676 | A * | 5/1989 | Johns et al. | 493/152 |
| 6,276,045 | B1 * | 8/2001 | Buchi et al. | 29/527.2 |
| 7,921,689 | B2 * | 4/2011 | Anderson et al. | 72/453.01 |
| 2003/0198703 | A1 * | 10/2003 | Johns et al. | 425/170 |
| 2005/0159284 | A1 | 7/2005 | Smith et al. | |
| 2008/0234119 | A1 | 9/2008 | Gontkosky et al. | |
| 2010/0024667 | A1 * | 2/2010 | Ikura | 100/38 |

FOREIGN PATENT DOCUMENTS

| | | | |
|---|---|---|---|
| JP | 2004 230873 | A | 8/2004 |
| JP | 2005 041488 | A | 2/2005 |

* cited by examiner

*Primary Examiner* — Christopher Harmon
(74) *Attorney, Agent, or Firm* — McGlew and Tuttle, P.C.

(57) ABSTRACT

This invention concerns a press and a method in particular for the forming of finished articles, such as containers or trays of paper and starting from a moisturized sheet. The press comprises a bedplate (18) having a fixed die holder plane (19) holding a head (20) with a moving die-holder plane (21) movable with regards to the fixed plane between an opening and a closing position. A lower die (22) is attached to the fixed die holder plane, whereas an upper die (23) is attached to the moving die-holder plane. The moving die-holder plane is powered by an electric actuator (29) for the opening and closing movements and the half-dies are provided with heating means for the drying and hardening of the paper in a set closed position. The moving die-holder plane can be slowed down or stopped during its stroke to allow for the drying of the paper.

8 Claims, 3 Drawing Sheets

PRESS AND METHOD IN PARTICULAR FOR THE PRESSURE FORMING OF PAPER CONTAINERS

FIELD OF THE INVENTION

This invention concerns the field of the machine for forming finished articles such as containers, trays, tubs using a deformable material, and refers in particular to a machine and a method for pressure forming containers, tubs or the like in paper.

STATE OF THE TECHNIQUE

On the one hand the pressure forming of containers and tubs made of aluminium using machines which are basically vertical presses are well known and comprise a forming station with a fixed half-die and a movable half-die on board, respectively, a lower die holder and an upper die holder. The material, in the shape of a strip, is led between the two half-dies which, approached and closed one on top of the other, form the container. The movement of the movable half-die is mechanical, carried out by toggle systems that use connecting rods and cranks, which in addition are difficult to control as regards the strokes, decelerations and stops, and are rather noisy, besides requiring frequent maintenance and cleaning.

On the other hand the formation of containers and trays made of paper with a configuration comparable to those made out of aluminium are well known.

At present they are manufacture through several phases starting from a sheet of moisturized paper and through a series of operations that are carried out using machines with a number of work stations and transferring the item from one station to another.

These machines however, besides being complex do not have a high output, due to the fact that the various forming phases of the item are not carried out in one run and require at least some passive transfer periods.

An attempt has also bee carried out to produce paper containers or trays using a mechanical type of machine, such as a press for the forming aluminium containers, starting from a sheet of moisturized paper. This attempt, however, did not produce satisfactory results in that, due to its characteristics, the traditional mechanical presses are not suitable for carrying out a forming operation when moisturized paper, which, for a good result, requires a particular procedure. In fact, with these machines it is not possible to carry out programmed stops of the movable plane in precise steps of its stroke as it is required in a strengthening phase of the paper.

OBJECTIVES AND SUMMARY OF THE INVENTION

One objective of this invention is to create the conditions for a simple forming of paper containers or trays using a machine, that is a press, which is much simpler and less expensive than the multi-station machines used up to now, more precise and silent as regards to the traditional mechanical presses used in the forming of aluminium containers or trays, and which, advantageously, requires less maintenance.

Another objective of the invention is to provide a machine or press, with a work cycle which, compared to the mechanical presses, can be managed better in relation to the treated material, moisturized paper, and to the forming procedure to manufacture paper containers or trays and with the further advantage of increased productivity, compared to the machines with multi-work stations due to the fact that at each closing or opening cycle of the die at least one item is produced or also as many finished items as there are impressions in the die.

These objectives and advantages are reached, in accordance with the invention, with a machine or press particularly for the forming of paper containers or tubs according to the preamble of claim 1 and where the moving die-holder plane is driven by an electric actuator for its opening and closing movements, and the die is provided with heating means for drying and hardening the paper in a given closed position of the die, before however starting the opening of the latter.

BRIEF DESCRIPTION OF THE DRAWINGS

Further details of the invention will however become evident from the following description made in reference to the enclosed indicative and not limiting drawings, in which.

DETAILED DESCRIPTION OF THE INVENTION

Figure 1:
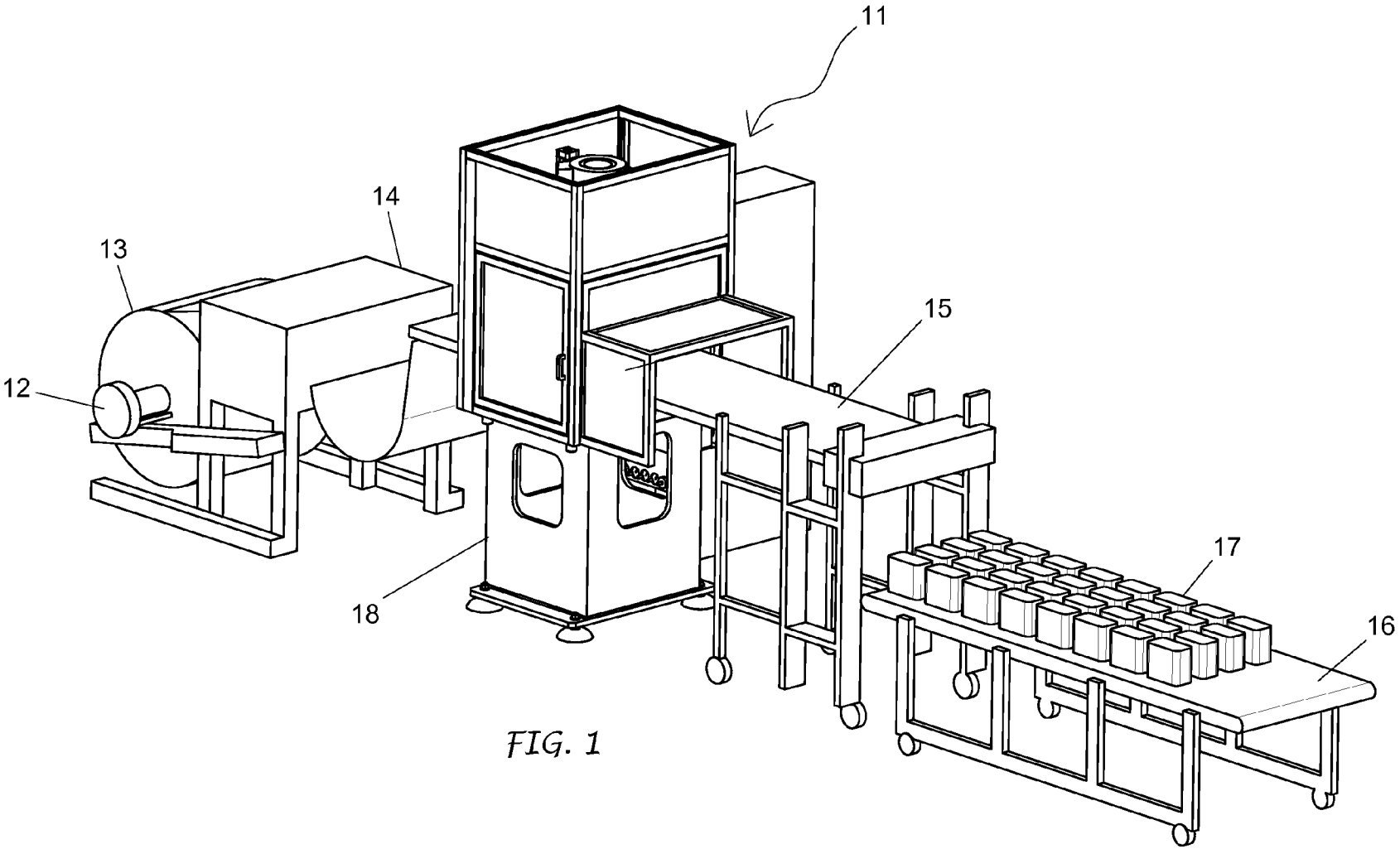
FIG. 1 shows a schematic view of a system for the manufacture of paper containers or tubs.
Figure 2:
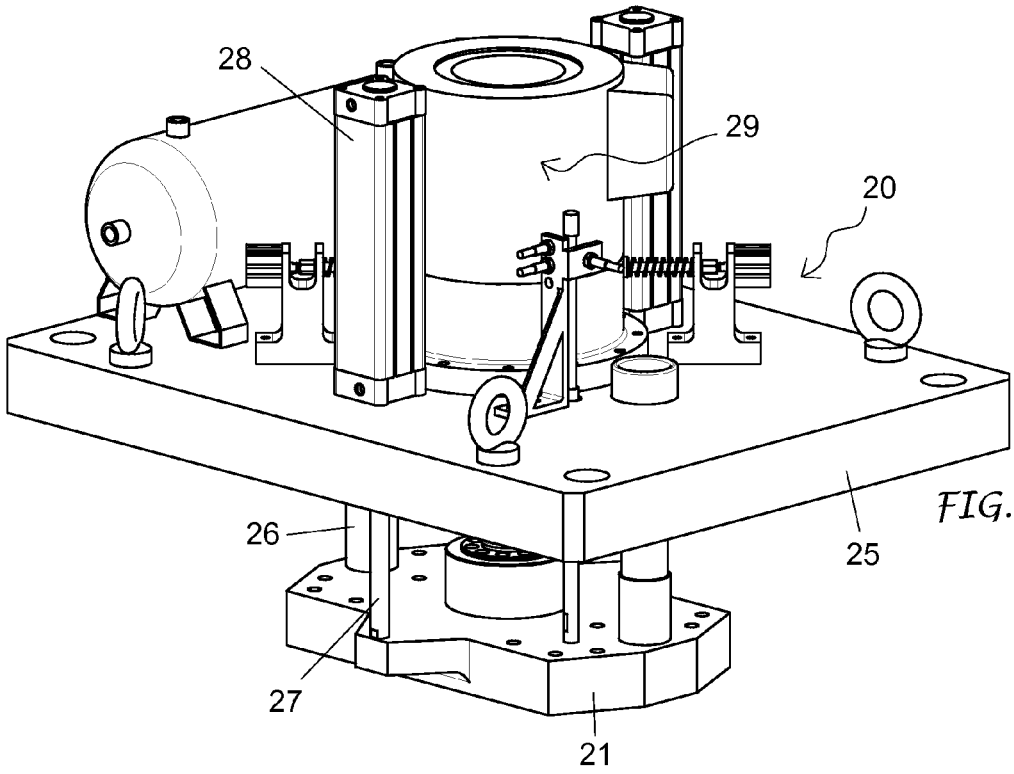
FIG. 2 shows also a schematic view of the head of the press according to the invention.
Figure 3:
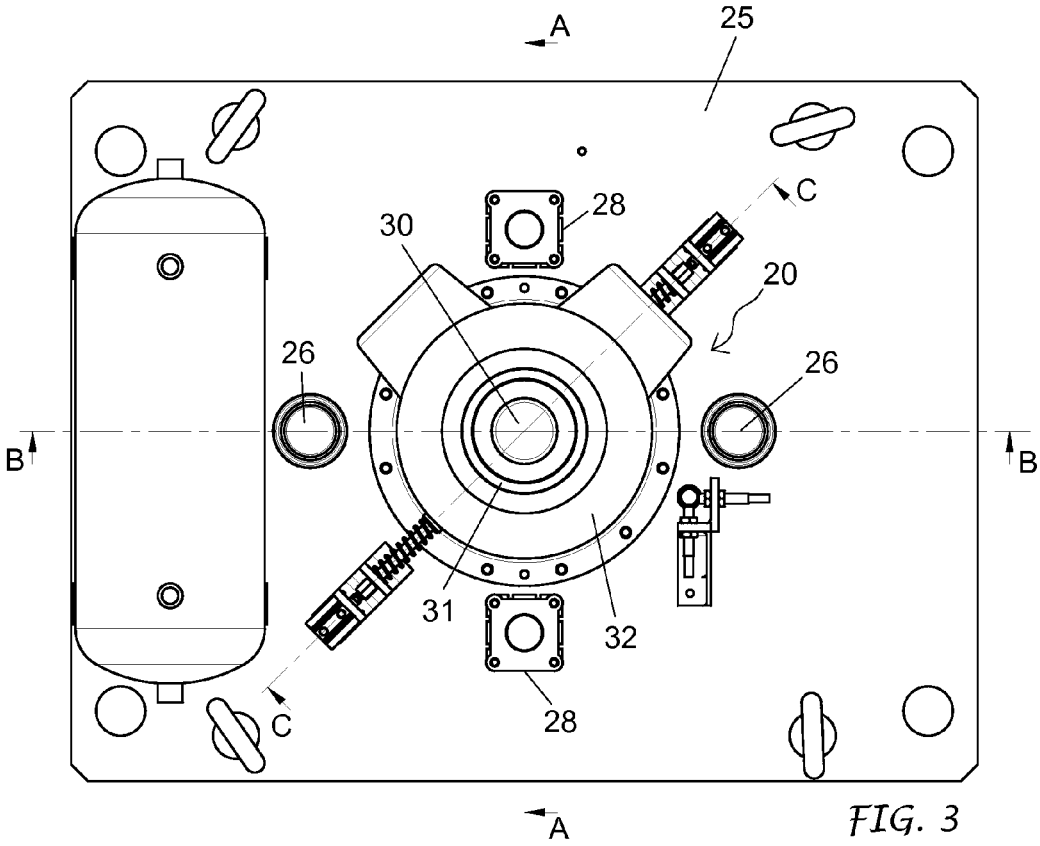
FIG. 3 shows a top view of the head in FIG. 2.

As shown, the machine proposed comprises, in association with a press 11, on one side, a support 12 carrying a reel of starting paper 13, means 14 for unwinding the paper from the reel, means for the intermittent advancement of the paper towards the press and, from the opposite side, besides a means for removing the shreds of paper, an automatic stacker 15 of the articles exiting from the press and a table 16 to stack the finished articles 17—FIG. 1.

Along the path between the reel and the press, although not represented, means to moisturize the paper according to requirements are provided.

Figure 4:
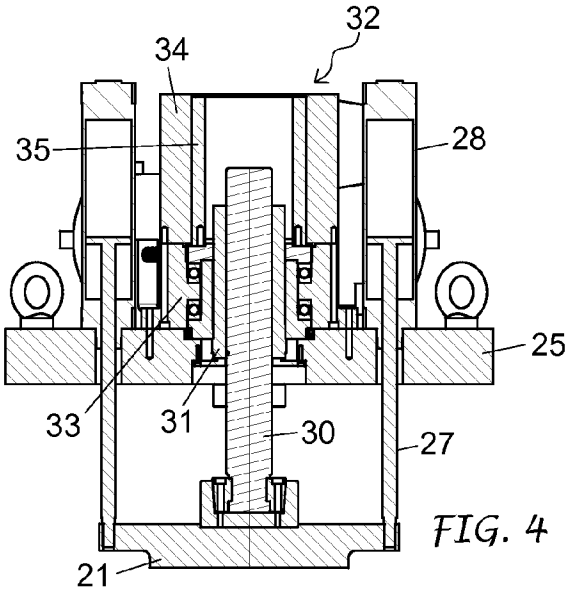
FIG. 4 shows a sectional view of the head according to arrows A-A in FIG. 3.
Figure 6:
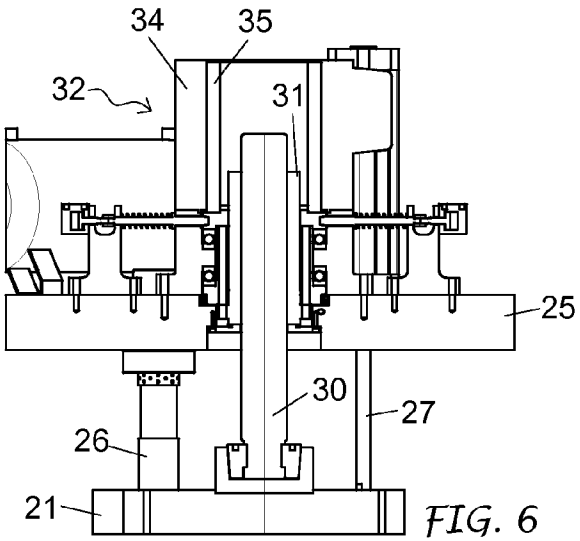
FIG. 6 shows a sectional view of the head according to arrows C-C in FIG. 3.
Figure 5:
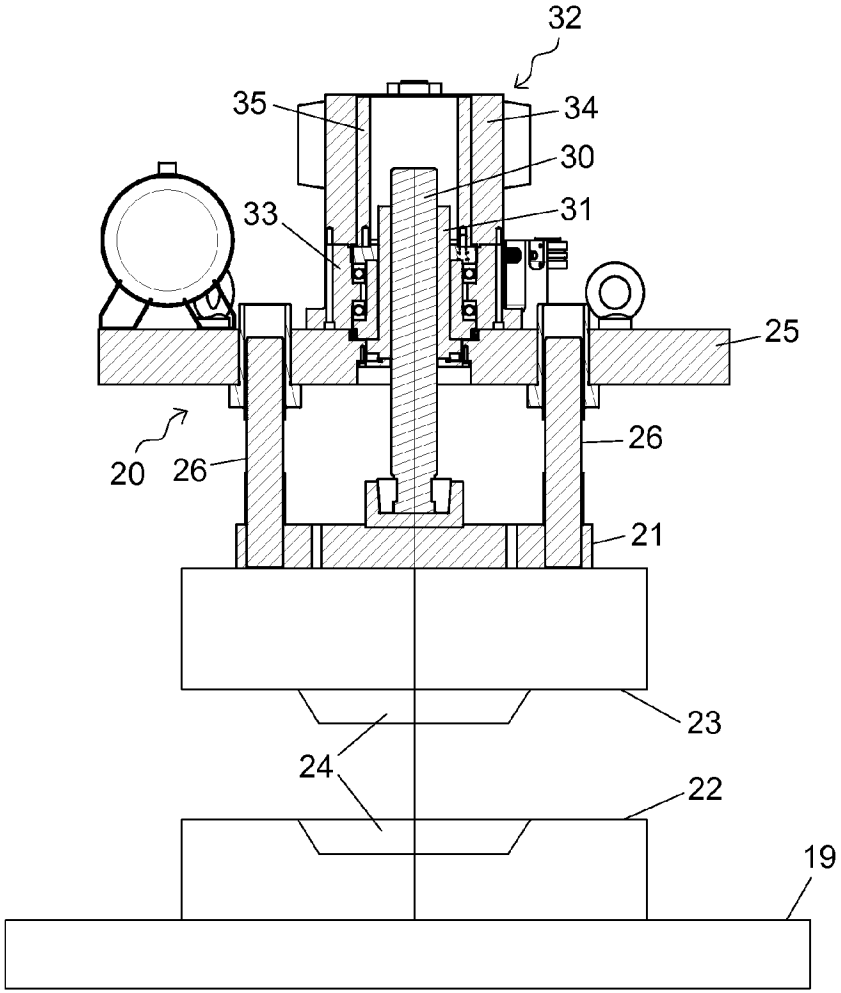
FIG. 5 shows a sectional view of the head according to arrows B-B in FIG. 3.

The press 11 has a bedplate 18 with—FIG. 4—a fixed die holder plane 19 and holding a head 20 with a movable die holder plane 21 above the fixed plane—FIG. 5. From time to time, a lower half-die 22 is fixed to the die holder plane 19, whereas an upper half-die 23 is fixed to the moving die-holder plane 21, the two half-dies 22, 23 forming complimentarily at least one impression 24 corresponding, in shape and size, to the finished article 17 to be produced.

According to one aspect of the invention, the components 22, 23 of the die are adequately heated to heat the moisturized paper to dry it in a set step of the forming cycle of the required article.

In particular, the head 20 of the press includes a plate or fixed crosspiece 25, and the moving die-holder plane 21 is mounted on said crosspiece 25, guided by means of bars 26 and supporting them by means of the piston rods 27 operating in pneumatic balancing cylinders 28 fixed to said plate or crosspiece.

The moving die-holder plane 21 is movable upwards between an open elevated position, in which the upper half-die 23 is distant from the lower half-die 22 on the fixed die holder plane 19, and a lowered closed position, in which the upper half-die is brought closer and conjugates with the lower half-die.

According to another aspect of the invention, the movements of the movable plane 21, and with it the upper half-die 23, from the opening position to the closed position and vice versa, are controlled by an electric actuator 29.

In the example illustrated in the drawings, this actuator 29 consists of a screw 30 which connects up to a ball or roller lead screw nut 31 and to an electric drive motor 32.

The screw 30 is fixed to the movable plane 21 and extends upwards to mate with the lead screw nut 31 supported by truing and supporting means 33 mounted on the fixed plate or crosspiece 25. The screw 30 is set up to translate axially without turning, whereas the lead screw nut 31 is subject to turning, without translating, commanded by the electric motor 32. Preferably, the electric motor is the "torque" type placed coaxially to the screw 30 and having a stator 34 fixed to the support 33 of the lead screw nut 31, and a rotor 35 fixed and rotating with the latter, even if this does not exclude that the electric motor may be of a different type and coupled to the lead screw nut by means of appropriate transmission means.

In any case, the axial movements of the screw for the advance and return strokes of the movable plane based on the rotations of the lead screw nut in one direction or the other and driven by the motor are caused, that is to say on the closing and opening of the die. These strokes, thanks to the electric actuator system can be programmed, run, finely adjusted, slowed down or stopped according to needs during the formation cycle of each finished article.

Practically, in the above described machine, the sheet of moisturized paper 13 is made to advance step by step between the open heated half-dies 22, 23. These are then approached and closed one on top of the other by the electric actuator 29, provoking at first the cutting of at least one rough paper blank corresponding to the development of the finished article to be produced and in succession the forming of a semi-finished container or tray, still without a border, corresponding to the shape of the impression defined by the half-dies. On nearing the end of the closing stroke of the half-dies, the electric actuator 29 is governed so as to slow down or in fact stop the movable plane 21 for a short period to allow the heating of the moisturized paper until it is dried by the hot half-dies. In this way the paper hardens, establishing the shape of the semi-finished article in this form.

After, the actuator 29 starts the return stroke upwards of the movable plane 21, during which, in a first phase, and with specific movements on the part of the half-dies, a border is formed around the edge of the container or tray so that it is similar to what takes place in the formation of aluminium trays, and in a second phase the release and ejection of the finished article.

Therefore, at each work cycle of the press one or more finished paper containers or trays, depending on the number of impressions in the die, are sent to the automatic stacker and from there to the accumulator table.

The invention claimed is:

1. A press particularly for forming finished articles, such as containers or trays of paper, starting from a sheet of moisturized paper, the press comprising:

a bedplate having a fixed die holder plane and holding a head with a moving die-holder plane movable, compared to the fixed plane, between an opening and closing position, wherein a lower half-die is attached to the fixed die holder plane, wherein an upper half-die is attached to the moving die-holder plane, said moving die-holder plane being powered by an electric actuator to actuate said opening and closing movements, said half-dies being provided with heating means to dry and harden the paper in a set closed position before the die begins the open movement, wherein said head comprises a plate or fixed crosspiece and the moving die-holder plane is mounted on said crosspiece, guided by bars and supported by means of piston rods operating in pneumatic balancing cylinders fixed to said plate or crosspiece, said electric actuator comprising a screw that connects up to a ball or roller lead screw nut and in an electric drive motor.

2. A press according to claim 1, wherein said screw of said actuator is attached to the movable plane to translate axially without turning and the lead screw nut is associated with a stationary support and subject to turning, without translating, controlled by an electric motor.

3. A press according to claim 1, wherein said electric motor is a "torque" motor placed coaxially to the screw and having a stator fixed to said support and a rotor fixed in rotation to the volute.

4. A method for forming finished articles, such as containers or trays using a press, starting from a sheet of moisturized paper, the method comprising the steps of:

providing a press comprising a bedplate having a fixed die holder plane and holding a head with a moving die-holder plane movable, compared to the fixed plane, between an opening and closing position, wherein a lower half-die is attached to the fixed die holder plane, wherein an upper half-die is attached to the moving die-holder plane, said moving die-holder plane being powered by an electric actuator to actuate said opening and closing movements, said half-dies being provided with heating means to dry and harden the paper in a set closed position before the die begins the open movement, wherein said head comprises a plate or fixed crosspiece and the moving die-holder plane is mounted on said crosspiece, guided by bars and supported by means of piston rods operating in pneumatic balancing cylinders fixed to said plate or crosspiece, said electric actuator comprising a screw that connects up to a ball or roller lead screw nut and in an electric drive motor;

intermittently conducting the sheet of moisturized paper between two open half-dies, defining at least an impression corresponding to the finished article to be produced;

closing of the two half-dies to cut the sheet of paper corresponding to the blank of the finished article followed by the forming of a semi-finished article, still without a border;

slowing down or temporarily stopping the half-dies in a closed position to establish the final shape of the semi-finished article; and opening of the two half-dies for the formation of a border around the finished article followed by the release and ejection of the finished article.

5. A method according to claim 4, wherein the semi-finished article is heated to dry the paper during the slowing down or temporarily stopping of the half-dies in their closed position.

6. A method according claim 4, wherein the heating of the semi-finished article is carried out through the half-dies.

7. A press according to claim 2, wherein said electric motor is a "torque" motor placed coaxially to the screw and having a stator fixed to said support and a rotor fixed in rotation to the volute.

8. A method according to claim 5, wherein the heating of the semi-finished article is carried out through the half-dies.

* * * * *